US005596356A

United States Patent [19]

Lee

[11] Patent Number: 5,596,356

[45] Date of Patent: Jan. 21, 1997

[54] TONER EJECTION PRINTER WITH DUMMY ELECTRODE FOR IMPROVING PRINT QUALITY

[75] Inventor: Michael H. Lee, San Jose, Calif.

[73] Assignee: Hewlett-Packard Company, Palo Alto, Calif.

[21] Appl. No.: 548,839

[22] Filed: Oct. 26, 1995

[51] Int. Cl.[6] ..... G03G 15/00

[52] U.S. Cl. ..... 347/55

[58] Field of Search ..... 347/55, 141, 123, 347/112

[56] References Cited

U.S. PATENT DOCUMENTS 3,689,935 9/1972 Pressman et al. ..... 347/55

5,353,050 10/1994 Kagayama ..... 347/55

*Primary Examiner*—Arthur T. Grimley

*Assistant Examiner*—Sophia S. Chen

*Attorney, Agent, or Firm*—Denise A. Lee

[57] ABSTRACT

The present invention provides a method and apparatus for toner ejection printing that improves print quality by providing a pair of dummy electrodes positioned adjacent to the end shield electrodes, the dummy electrodes for improving print uniformity by maintaining a consistent charge environment for the aperture currently printing. The image recording apparatus is comprised of a developer supply for providing electrostatically charged toner particles, a printhead structure, the printhead structure having a first major surface and a second opposite major surface, wherein a plurality of gate electrodes $B_1, \ldots B_{n-1}, B_n$ are formed on the first major surface of the printhead structure, a plurality of shield electrodes $C_1, \ldots C_{m-1}, C_m$ are formed on the second major surface of the printhead structure, and at least a first dummy electrode $X_p$ is formed on the second major surface adjacent to electrode $C_m$, the printhead structure including a plurality of apertures extending from the gate electrodes $B_1, \ldots B_{n-1}, B_n$ to corresponding shield electrodes $C_1, \ldots C_{m-1}, C_m$, a back electrode disposed in opposed relation with a surface of the printhead structure, and a control circuit for applying controlled electrical signals to the printhead structure, the electrical signals causing the electrostatically charged toner particles to flow through selected apertures towards the back electrode.

3 Claims, 3 Drawing Sheets

TONER EJECTION PRINTER WITH DUMMY ELECTRODE FOR IMPROVING PRINT QUALITY

BACKGROUND OF THE INVENTION

The invention is directed towards the field of printers and more specifically to the field of electrostatic printers.

Electrophotographic (EP) primers generically called laser printers, are becoming increasingly common. Although electrophotography produces high print quality, the process is relatively complex and requires a bulky printing apparatus. An alternative to EP printing is toner ejection printing (TEP), described in U.S. Pat. No. 3,689,935 to Pressman, et al. The print quality of the TEP process theoretically should approach that of EP printers. However, the TEP process uses only two steps rather than the six steps required by conventional EP processes. This consolidation has attracted increasing interest due to the possibility of reduced costs.

FIG. 1A shows a cross-sectional partial schematic view of a conventional toner ejection printer 100 such as is described in Pressman, et al. FIG. 1B shows a view of the printhead 106 shown in FIG. 1A along lines A—A. The printhead 106 of the TEP printer 100 has a plurality of apertures 108 that allow charged toner particles 110 to pass from the toner supply 112 to the back electrode 114. A continuous shield electrode 118 is formed on the surface of the printhead 106 facing the toner supply 112 is coupled to ground. Gate electrodes 120 are formed on the surface of the printhead opposite to the shield electrode 118 facing the back electrode. Individual apertures are selectively opened or closed by applying the appropriate voltage to the corresponding gate electrode 120.

In an alternative TEP configuration, the shield electrode 118 is eliminated (no ground plane) and a single gate electrode layer for addressing individual aperture is used. Although the ground-free configuration has the advantage that a much smaller gate voltage can be used to open and close individual apertures, cross talk can be very significant. Crosstalk is problematic since the charge of neighboring electrodes can affect spot development.

As pixel density increases so does the related interconnect circuitry and driver circuitry necessary to support the added pixel density. In order to drive a large array of pixels, address multiplexing is sometimes used. U.S. Pat. No. 5,353,050 to Kagayama describes a printer where the address electrodes are multiplexed. FIG. 2A shows a cross-sectional partial schematic view of a conventional toner ejection printer 200 where the address electrodes are multiplexed. FIG. 2B shows a top view of the printhead shown in FIG. 2A along lines A—A.

Although multiplexing allows increased pixel density, it has the disadvantage of potentially providing an inconsistent environment for the pixels currently being developed. Consider a first case where an end gate electrode row 204 and an interior gate electrode row 206 are both on simultaneously while the remaining gate electrode rows are off. Assuming a negative toner, a typical potential for the electrode rows that are on would be 0 volts while a typical potential for the electrode rows that are off would be −300 volts. In a second case, the gate electrode rows are sequentially addressed so that electrode rows 204 and 206 are on at a different times. The apertures in electrode row 204 experience a different local environment than the apertures in electrode row 206, since electrode row 204 has only one adjacent row off while electrode row 206 has two adjacent rows off.

Electrostatically charged toner particles react to the electric field. Thus, the difference in the local environment can lead to differences between the amount of toner particles deposited through the aperture that are on in row 204 versus the amount of charge deposited through the aperture that are on in row 206. If the toner particles sense a high electric field, more toner particles can overcome their adhesion to the developer roll causing the toner particle to move more quickly from the developer roll towards the aperture. If the toner particle senses a low electric field, less toner particles overcome their adhesion to the developer roll and toner particles move more slowly towards the aperture. This results in a smaller amount of toner deposited and thus a lighter pixel compared to the pixel in the high electric field case. Although the speed of the toner particle may not be critical in EP printers, toner particle speed is critical in TEP printers because of the small development time window for each pixel.

A toner ejection printer which improves print quality by providing a more uniform local charge environment to improve pixel tonal uniformity is needed.

SUMMARY OF THE INVENTION

The present invention provides a method and apparatus for toner ejection printing that improves print quality by providing a pair of dummy electrodes positioned adjacent to the end shield electrodes, the dummy electrodes for improving print uniformity by maintaining a consistent charge environment for the aperture currently printing. The image recording apparatus is comprised of a developer supply for providing electrostatically charged toner particles, a printhead structure, the printhead structure having a first major surface and a second opposite major surface, wherein a plurality of gate electrodes $B_1, \ldots B_{n-1}, B_n$ are formed on the first major surface of the printhead structure, a plurality of shield electrodes $C_1, \ldots C_{m-1}, C_m$ are formed on the second major surface of the printhead structure, and at least a first dummy electrode $X_p$ is formed on the second major surface adjacent to electrode $C_m$, the printhead structure including a plurality of apertures extending from the gate electrodes $B_1, \ldots B_{n-1}, B_n$ to corresponding shield electrodes $C_1, \ldots C_{m-1}, C_m$, a back electrode disposed in opposed relation with a surface of the printhead structure, and a control circuit for applying controlled electrical signals to the printhead structure, the electrical signals causing the electrostatically charged toner particles to flow through selected apertures towards the back electrode. Preferably, the image recording apparatus includes a second dummy electrode formed on the first major surface, the second dummy electrode $X_{p+1}$ being positioned adjacent to the electrode $C_1$.

For a conventional TEP printer where the address electrodes are multiplexed, an aperture being addressed on a first electrode row may experience a different local environment than an aperture being addressed on a second electrode row. Specifically, an example where this occurs is the case the first electrode row and second electrode row are being simultaneously addressed and the first electrode row is an interior shield electrode row and the second electrode row is an end electrode row. In the present environment, to ensure a consistent local environment, in the present invention a pair of dummy electrodes are formed on the second major surface of the printhead, the surface facing the developer supply. By controlling the voltages applied to the gate, shield and dummy electrodes, a consistent local environment is provided to the aperture currently printing, thus improving tonal uniformity of the primed pixel.

In the preferred embodiment, the voltages to the gate, shield and dummy electrodes are such that the two rows adjacent to the row of the aperture currently being addressed are both off. Preferably both the first and second dummy electrodes are off. Thus in the case of an end shield electrode being addressed, for example $C_m$, the dummy electrode adjacent to the shield electrode is off and the shield electrode $C_{m-1}$ is off. In the case of an interior shield electrode being addressed, for example $C_2$, the shield electrodes $C_1$ and $C_3$ are both off. The addition of the dummy electrodes to the printhead structure, allows the end shield electrode rows to be able to experience the same local environment as the interior shield electrode rows. Thus the printhead structure can consistently provide a local environment, where the two rows adjacent to the one currently being addressed are off. By presenting a uniform local environment, uniform print tonality can be achieved. If necessary, the dummy electrodes may be shaped to fine tune and provide a more consistent the local environment.

A further understanding of the nature and advantages of the present invention may be realized with reference to the remaining portions of the specification and the attached drawings.

DETAILED DESCRIPTION OF THE PREFERRED EMBODIMENTS

Figure 1A:
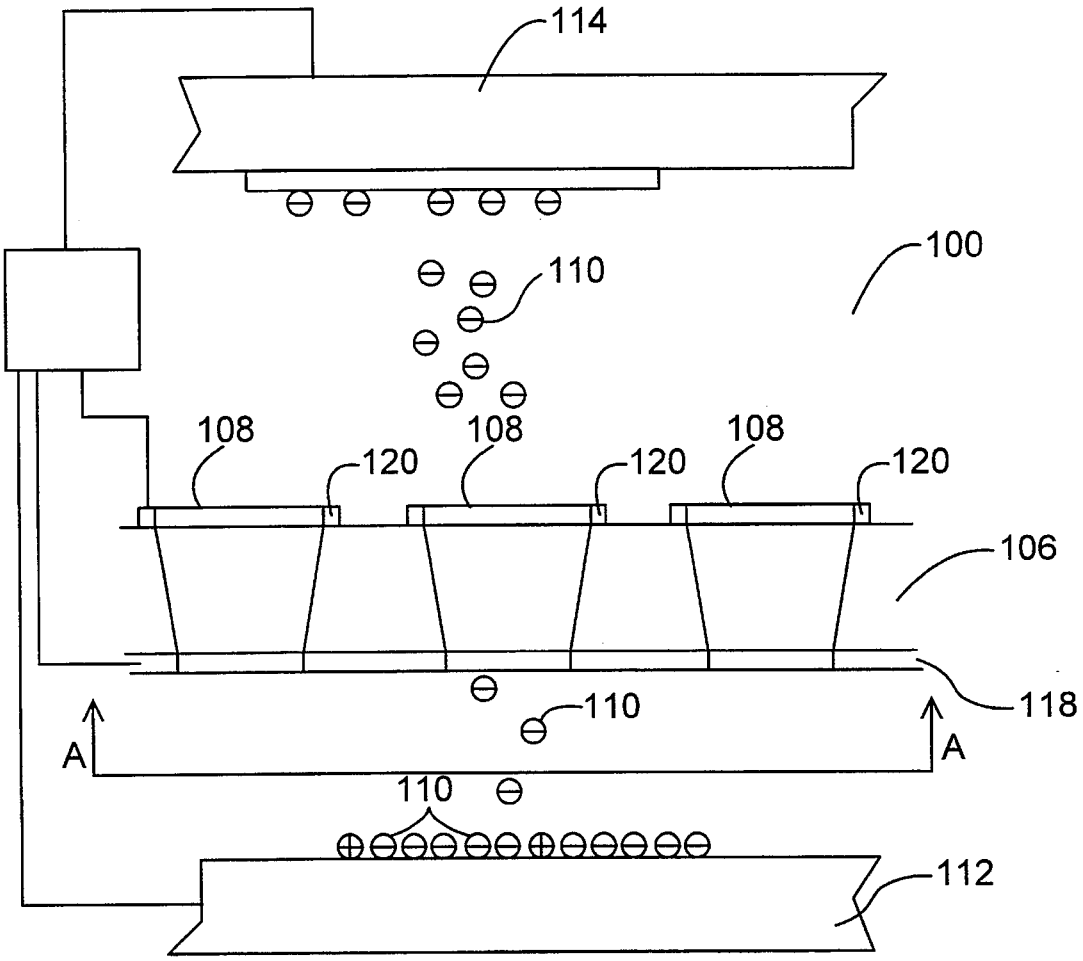
FIGURE 1A PRIOR ART
FIG. 1A shows a cross-sectional partial schematic view of a conventional toner ejection printer.
Figure 1B:
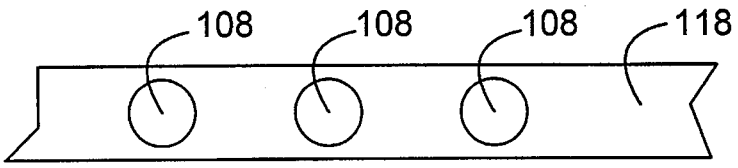
FIGURE 1B PRIOR ART
FIG. 1B shows a top view of the printhead of the toner ejection printer shown in FIG. 1A along lines A—A.
Figure 2A:
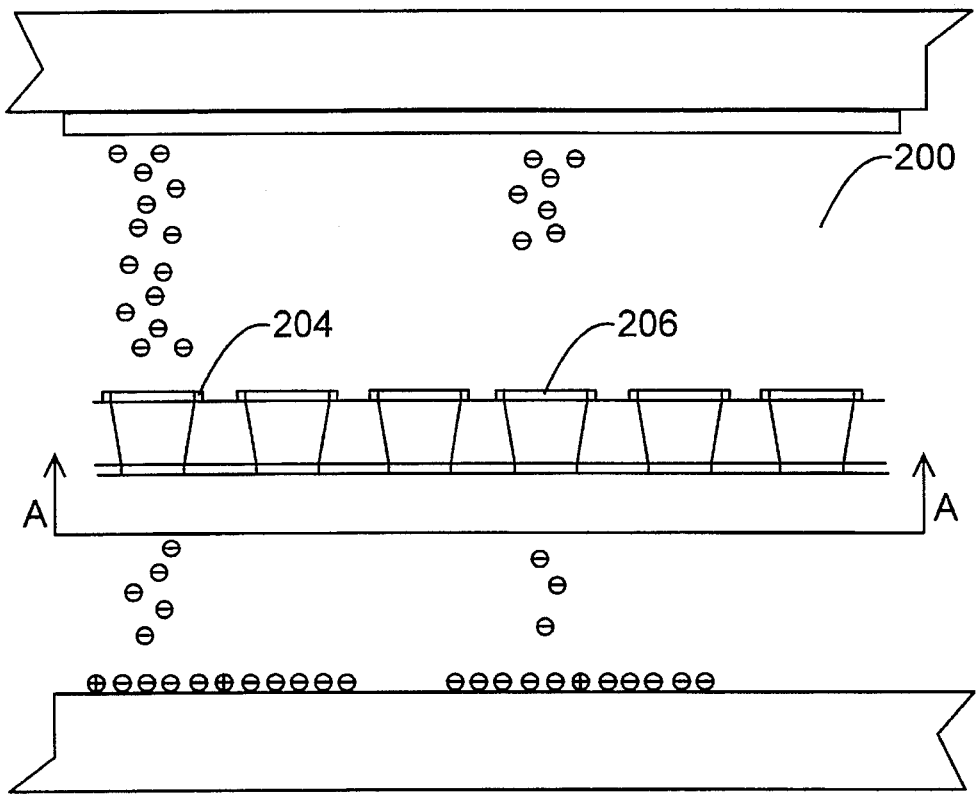
FIGURE 2A PRIOR ART
FIG. 2A shows a cross-sectional partial schematic view of a conventional toner ejection printer which uses multiplexed address electrodes.
Figure 2B:
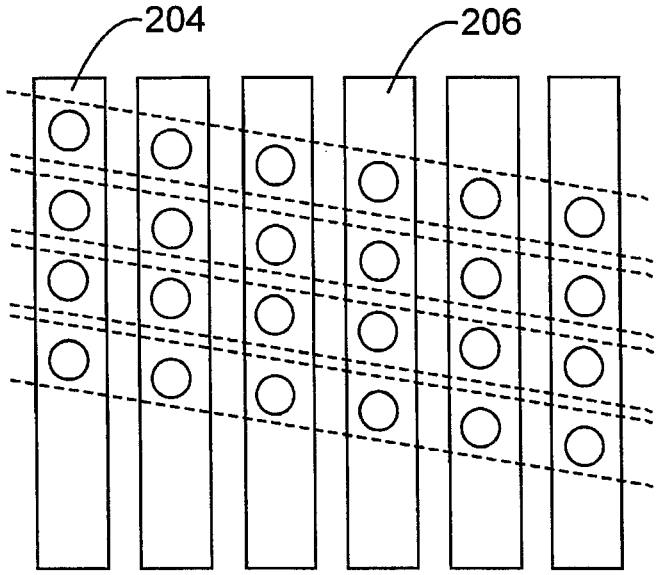
FIGURE 2B PRIOR ART
FIG. 2B shows a top view of the printhead of the toner ejection printer shown in FIG. 2A along lines A—A.
Figure 3A:
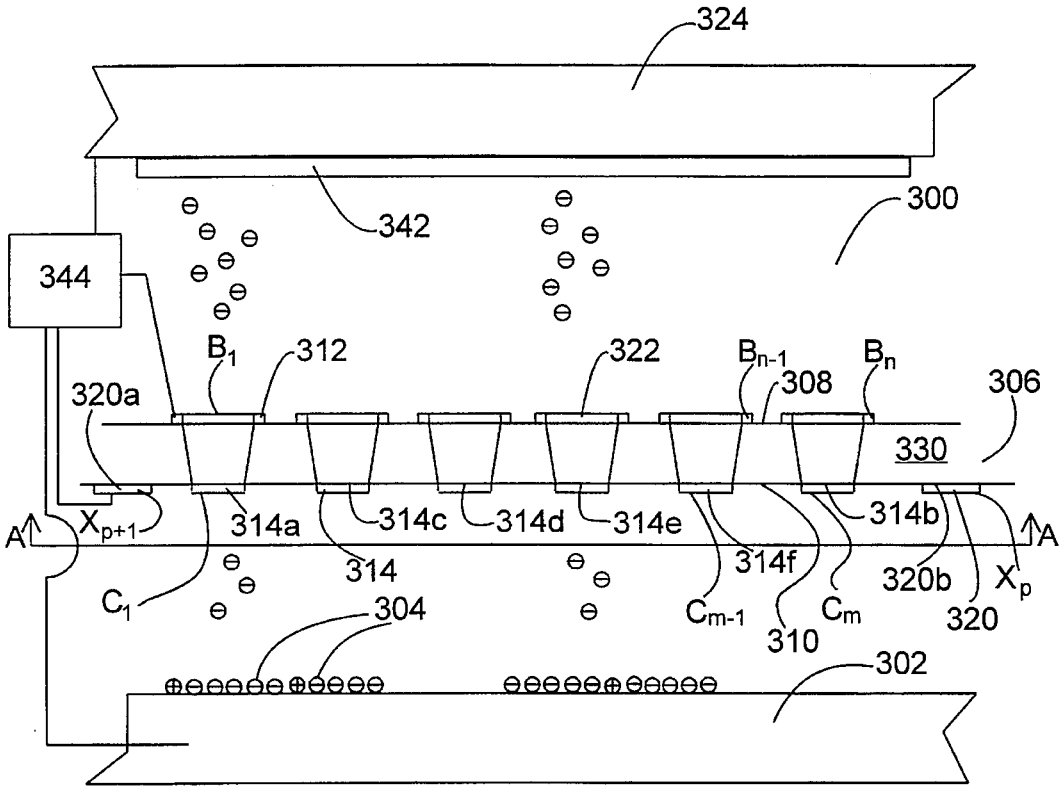
FIG. 3A shows a cross-sectional partial schematic view of a toner ejection printer according to the present invention.

The present invention provides a method and apparatus for toner ejection printing that improves print quality by providing a dummy electrode positioned adjacent to the gate electrode, the dummy electrode for improving print uniformity by maintaining a consistent charge environment for the aperture currently printing. Referring to FIG. 3 A shows a cross-sectional partial schematic view of a toner ejection printer 300 according to the present invention. The toner ejection printer 300 includes a developer supply 302 for providing electrostatically charged toner particles 304, a printhead structure 306, the printhead structure 306 having a first major surface 308 and a second opposite major surface 310, wherein a plurality of gate electrodes 312 are formed on the first major surface 308 of the printhead structure 306, a plurality of shield electrodes 314 are formed on the second major surface 310 of the printhead structure 306, and at least a first dummy electrode 320*a* formed on the second major surface 308 adjacent to an end shield electrode 314*a*, the printhead structure 306 including a plurality of apertures 322 extending from the plurality of shield electrodes 312 to the corresponding plurality of gate electrodes 312, a back electrode 324 disposed in opposed relation with the first major surface of the printhead structure; and a control circuit 344 for applying controlled electrical signals to the printhead structure 306, the electrical signals causing the electrostatically charged toner particles to flow through selected apertures towards the back electrode 324. Preferably, the toner ejection printer 300 includes a second dummy electrode 320*b* formed on the second major surface, the second dummy electrode 320*b* being positioned adjacent to a second end shield electrode The toner ejection printer 300 includes a developer supply 302 for providing electrostatically charged toner particles 302. The developer supply 304 is spaced apart from the printhead 306 by approximately 50 to 150 μm, preferably 75 to 100 μm. The toner particles 304 may be comprised of any suitable non-magnetic insulative toner combination. The toner 304 may be positively or negatively charged. For purposes of discussion in this application, the toner 304 is assumed to be negatively charged. (If magnetic insulative toner is used, the spacing is typically increased to between 125 to 350 μm, preferably 150 to 250 μm).

The printhead structure 306 is positioned in the toner ejection printer 300 such that the gate electrode 312 faces the back electrode 324 and the shield electrode 314 faces the developer supply 302. The printhead structure 306 is comprised of an electrically insulative base member 330, a plurality of gate electrodes 3 12, and a plurality of shield electrodes 314. The electrically insulative base member 330 is typically made from polyimide film having a thickness in the range of 25 to 125 μm, preferably 50 to 100/m, although other insulative materials and thicknesses may be used.

A plurality of segmented shield electrodes 314 are formed on the second major surface 310 of the base member 330. The shield electrodes 314 are typically made of Cr—Au having a total thickness of approximately 0.1 to 0.5 μm, preferably 0.2 to 0.5 μm thick. The spacing between adjacent shield electrodes 314 should be minimized, around 40 μm, and the shield electrodes 314 preferably overcoated with an insulator to eliminate arcing between adjacent shield electrodes.

A plurality of segmented conductive gate electrodes 312 are fabricated on the first major surface 308 of the base member 330. Similar to the conductive shield electrode 314, the gate electrode 312 is typically comprised of Cr—Au having a thickness of approximately 0.2 μm to 1 μm, and preferably 0.3 to 0.6 μm thick.

A plurality of holes or apertures 322 are formed in the printhead structure 306, the apertures extending from the first major surface 308 of the printhead structure to the second major surface 310 of the printhead structure. Specifically, the apertures 322 extend from the shield electrode structures to the corresponding gate electrode structure positioned directly above the shield electrodes. The apertures 322 are typically cylindrical and approximately 100 to 180 μm, preferably 120 to 160 μm in diameter. The apertures form an electrode array of individually addressable electrodes in a pattern suitable for use in recording information. Preferably, apertures do not extend through the dummy electrodes 320*a* and 320*b*.

Figure 3B:
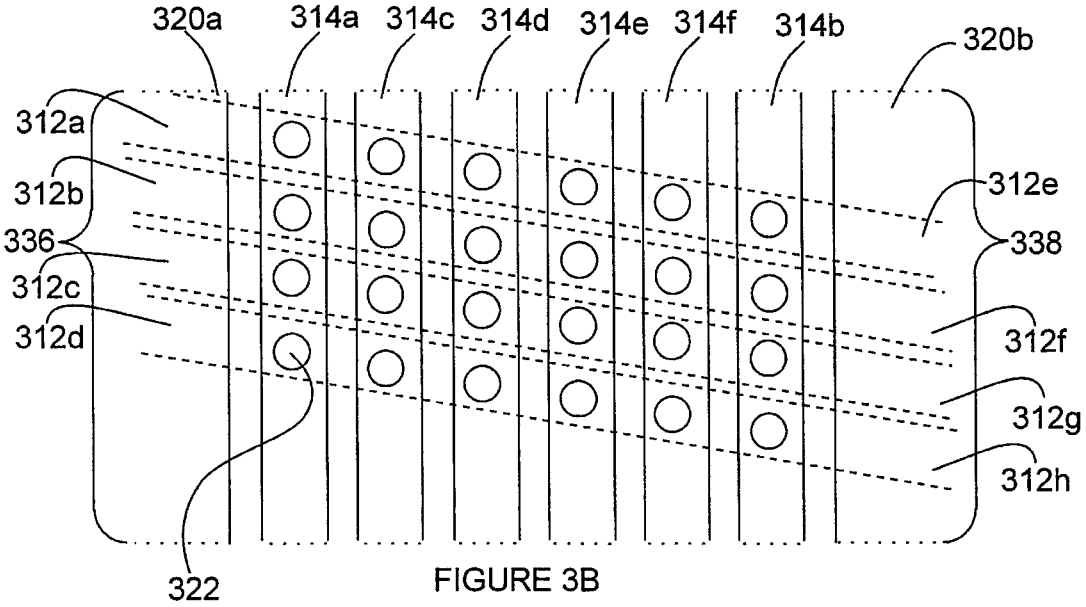
FIG. 3B shows a top view of the printhead of the toner ejection printer shown in FIG. 3A along lines A—A.

Referring to FIG. 3B, electrode rows 314 are representative of the shield electrodes where 314*a* and 314*b* are end shield electrodes and electrodes 314*c*–314*f* are interior shield electrodes. Dummy electrodes 320*a* and 320*b* are positioned adjacent to the end shield electrodes 314*a* and 314*b*. The dotted lines are representative of a plurality of gate electrodes 312. In the embodiment shown in FIG. 3B, the gate electrodes 312 are divided into two banks, in order to increase the addressing speed. Referring to FIG. 3B, the first bank of gate electrodes 336 includes gate electrodes 312*a*, 312*b*, 312*c*, 312*d* while the second bank of gate electrodes 338 includes gate electrodes 312*e*, 312*f*, 312*g*, and 312*h*. Each set of gate electrodes each connects three nozzles. Addressing speed is increased since two gate electrodes can be addressed simultaneously. For example, apertures in electrode row 314*a* and 314*e* can be addressed simultaneously.

Consider the case of a toner ejection printer printing 600 dpi, where the dot pitch is 42 μm. For a printer having six rows of apertures, the apertures are positioned 254 μm apart center-to-center, six times the dot pitch. For the two-sided, triple-connect scheme shown in FIG. 3B, a reasonable spacing from one row to the next through the aperture centers is 268 μm, which is approximately 6.333 times the dot pitch. From row to row, the dots are moved perpendicular to the developer roll axis by 42 μm to cover all the positions in the 600 dpi layout.

The back electrode 324 is disposed in opposed relation with the second major surface 310 of the printhead structure 306. In the preferred embodiment, the back electrode 324 is a rotatable conducting drum. Typically a copy substrate 342 is positioned on the surface of the back electrode 324 to record the toner pattern. Alternatively, toner 304 can be directly deposited on the electrode surface and is subsequently transferred to the recording substrate at another location.

A control circuit 344 applies controlled electrical signals to the printhead structure 306, the developer supply 302 and the back electrode 324, causing electrostatically charged toner particles 304 to flow through selected apertures towards the back electrode 324. Addressing of the individual electrical electrodes and multiplexing individual electrodes is well known in the art and any number of addressing methods may be used to electronically select the desired printing element.

In the preferred embodiment where the toner particles 304 are negatively charged, the control circuit 344 electrically couples the back electrode 324 to a high voltage source, electrically couples the dummy electrodes 320 to a low voltage source, and electrically couples the gate electrodes 312, the shield electrodes 314, and the developer supply 302 to a modulating signal source. The signal applied to the back electrode 324 is a high voltage source, typically in the range of 0.8 to 1.5 k volts, preferably 1.0 to 1.3 k volts so that streams of the charged toner particles flowing through the selected aperture are then electrostatically attracted to the back electrode 324 to deposit the charged toner particles 304 onto the drum surface of the back electrode 324 as the drum rotates or to the receiving substrate 342 in front of the back electrode 324.

In the preferred embodiment, the dummy electrodes 320 are always off and typically coupled to a negative voltage, for example a voltage of −300 volts. The gate electrodes 312 are coupled to a modulating voltage source which varies, for example, between −300 volts when off and −20 volts when on. Similarly the shield electrodes are coupled to a modulating voltage source which varies, for example, between 0 volts when on and −300 volts when off. In the preferred embodiment, the developer roller voltage is +340 volts to which a −600 V, 200 μs pulse at 3.54 kHz (3×600 dpi at 5 cm/s) is added. Even though the average voltage on the developer roll is clearly negative, toner pileup can be avoided because the −300 volts on the shield electrode is applied except when the row is turned on. The maximum pulse height is −260 volts. Since the toner is negative, no projection occurs unless the developer roll voltage is more negative than the shield electrode voltage. Hence the shield electrode off state can be taken as lower than the −300 volts, probably even lower than −260 volts because the toner must overcome its adhesion to the developer roll in order to project towards the aperture.

In the preferred embodiment, the voltages applied to the gate 312, shield 314 and dummy electrodes 320 are such that the two rows adjacent to the row of the aperture currently being addressed are both off. Preferably both the first and second dummy electrodes 320*a*, 320*b* are always off. Thus in the case of an end shield electrode (314*a* or 314*b*) being addressed, for example $C_m$, the dummy electrode adjacent to the shield electrode is off and the shield electrode $C_{m-1}$ is off. In the case of an interior shield electrode being addressed, for example $C_r$, the shield electrodes $C_{r-1}$ and $C_{r+1}$ are both off. The addition of the dummy electrodes (314*a*,314*b*) to the printhead structure 306, allows the end shield electrode rows (314*a*, 314*b*) to be able to experience the same local environment as the interior shield electrode rows (314*c*,314*d*,314*e*,314*f*). Thus the printhead structure 306 can provide a consistent local environment.

To determine the multiplexing timing scheme, consider a copy substrate 342 moving from let to right at 5 cm/sec (42 μm in 0.85 ms). Preferably, all shield row electrodes 314 remain in the off state except for the two rows to be (simultaneously) written. Consider the case where electrodes 314*a* and 314*e* are both on and electrode 320*a*, 320*b*, 314*b*,314*c*, 314*d*, and 314*f* are off. Next, electrodes 314*d* and 314*b* are turned on. Although electrodes 314*d* and 314*e* are 6.333 pitch apart, the substrate motion causes the dots to be formed 6 pitch apart. The cycle of addressing electrodes is repeated until all dots in a single horizontal line are covered.

It is understood that the above description is intended to be illustrative and not restrictive. By way of example, the number of rows in the off state that adjacent to the aperture currently being addressed can be increased. For example, the four rows closest to the aperture being addressed may be in the off state. The scope of the invention should therefore not be determined with reference to the above description, but instead should be determined with reference to the appended claims, along with the full scope of equivalents to which such claims are entitled.

What is claimed is:

1. An image recording apparatus comprised of:

a developer supply for providing electrostatically charged toner particles;

a printhead structure, the printhead structure having a first major surface and a second opposite major surface, wherein a plurality of gate electrodes $B_1, \ldots B_{n-1}, B_n$ are formed on the first major surface of the printhead structure, a plurality of shield electrodes $C_1, \ldots C_{m-1}, C_m$ are formed on the second major surface of the printhead structure, and at least a first dummy electrode $X_p$ is formed on the second major surface adjacent to electrode $C_m$, the printhead structure including a plurality of apertures extending from the gate electrodes $B_1, \ldots B_{n-1}, B_n$ to corresponding shield electrodes $C_1, \ldots C_{m-1}, C_m$;

a back electrode disposed in opposed relation with a surface of the printhead structure; and a control circuit for applying controlled electrical signals to the printhead structure, the electrical signals causing the electrostatically charged toner particles to flow through selected apertures towards the back electrode.

2. The image recording apparatus recited in claim 1 further comprising a second dummy electrode $X_{p+1}$ formed on the second major surface, the second dummy electrode being positioned adjacent to the electrode $C_1$.

3. The image recording apparatus as recited in claim 2 wherein the first dummy electrode and the second dummy electrode are off.

* * * * *